US008833260B2

(12) United States Patent
Kim et al.

(10) Patent No.: US 8,833,260 B2
(45) Date of Patent: Sep. 16, 2014

(54) AUTOMATIC STAMPING METHOD AND APPARATUS BASED ON PRESS ROLLER AND PIN PRESS

(75) Inventors: Dong Ho Kim, Daejeon (KR); Yong Hoon Choi, Daejeon (KR); Jae Gwan Song, Daejeon (KR); Hyeon Guk Kim, Chungnam (KR); Hoon Jung, Daejeon (KR); Jong Heung Park, Daejeon (KR)

(73) Assignee: Electronics & Telecommunications Research Institute, Daejeon (KR)

( * ) Notice: Subject to any disclaimer, the term of this patent is extended or adjusted under 35 U.S.C. 154(b) by 349 days.

(21) Appl. No.: 13/289,342

(22) Filed: Nov. 4, 2011

(65) Prior Publication Data

US 2012/0114834 A1 May 10, 2012

(30) Foreign Application Priority Data

Nov. 5, 2010 (KR) ..... 10-2010-0110023

(51) Int. Cl.
*B41F 1/10* (2006.01)
*G07B 17/00* (2006.01)

(52) U.S. Cl.
CPC *G07B 17/00508* (2013.01); *G07B 2017/00709* (2013.01); *G07B 2017/00556* (2013.01); *G07B 2017/00516* (2013.01)
USPC ..... 101/490; 101/91; 101/93.05

(58) Field of Classification Search
USPC ..... 101/93.05
See application file for complete search history.

(56) References Cited

U.S. PATENT DOCUMENTS

| | | | | | |
|---|---|---|---|---|---|
| 3,495,216 | A * | 2/1970 | Silverschotz | ..... | 340/146.2 |
| 4,396,303 | A * | 8/1983 | Uddgren | ..... | 400/103 |
| 5,712,921 | A * | 1/1998 | Zabele | ..... | 382/112 |
| 5,839,367 | A * | 11/1998 | Hashimoto | ..... | 101/316 |
| 5,978,781 | A * | 11/1999 | Sansone | ..... | 705/408 |
| 6,208,980 | B1 * | 3/2001 | Kara | ..... | 705/408 |
| 6,449,385 | B1 * | 9/2002 | Huber et al. | ..... | 382/112 |
| 6,840,168 | B2 | 1/2005 | Itoh et al. | | |
| 7,407,195 | B2 | 8/2008 | Berson | | |
| 2004/0163558 | A1 | 8/2004 | Itoh et al. | | |
| 2006/0096482 | A1 * | 5/2006 | Duke | ..... | 101/483 |

FOREIGN PATENT DOCUMENTS

| | | |
|---|---|---|
| JP | 6-9896 | 2/1994 |
| JP | 11-115295 A | 4/1999 |
| KR | 10-0528111 B1 | 11/2005 |
| KR | 10-0541493 | 12/2005 |
| KR | 2008-0011683 A | 2/2008 |

* cited by examiner

*Primary Examiner* — Jill Culler
(74) *Attorney, Agent, or Firm* — Rabin & Berdo P.C.

(57) ABSTRACT

An automatic stamping apparatus includes a conveyor for conveying a stamping object, a stamper for stamping a pattern and two-dimensional bar code information on the stamping object, a reader for reading the pattern and the two-dimensional bar code information, and an information processor for determining a pattern and two-dimensional bar code information to be stamped on the stamping object, controlling the stamper based on the determined pattern and two-dimensional bar code information, receiving the stamped pattern and two-dimensional bar code information of the stamping object read by the reader, comparing the received stamped pattern and two-dimensional bar code information with a pattern and two-dimensional bar code information to be stamped on the stamping object, thus verifying the accuracy of the stamping.

13 Claims, 2 Drawing Sheets

AUTOMATIC STAMPING METHOD AND APPARATUS BASED ON PRESS ROLLER AND PIN PRESS

CROSS-REFERENCE TO RELATED PATENT APPLICATION

This application claims the benefit of Korean Patent Application No. 10-2010-0110023, filed on Nov. 5, 2010, in the Korean Intellectual Property Office, the disclosure of which is incorporated herein in its entirety by reference.

BACKGROUND OF THE INVENTION

1. Field of the Invention

The present invention relates to an automatic stamping method and apparatus and, more particularly, to an automatic stamping method and apparatus which can stamp a postmark or receipt mark on various paper sheets such as postal matters, bills, courier or parcel invoices, etc. in a press manner.

2. Description of the Related Art

Typically, a stamp is affixed to an envelope of a letter as a general postal matter to verify payment, and when the letter is deposited in a post office, a postmark is stamped on the corresponding letter to verify the payment and prevent reuse of the stamp.

Moreover, when a person receiving a bill visits an agency and pays the bill, a recipient of the agency stamps a receipt mark by hand with a stamping tool using ink or by putting a plurality of bills into an automated apparatus one by one.

As such, the stamping process using ink has many advantages and thus is widely used in many fields. However, the ink used in the automated apparatus equipped with an electronic device is expensive, and the cost of purchasing the ink is rapidly increased according to an increase in processing volume. Moreover, the post mark or receipt mark stamped on the letter or bill smears with water and thus cannot be identified.

Therefore, there are many prior arts related to an apparatus for stamping a postmark or receipt mark on paper sheets such as postal matters in a press manner.

For example, Korean Patent No. 0528111 discloses a paper sheet stamping apparatus, which stamps a postmark on a postal matter conveyed by a conveyor belt and passing through a press roller, and Korean Patent No. 0541493 discloses a paper-like material conveying apparatus, a paper-like material conveying direction switching apparatus, and a paper-like material stamping apparatus, which can facilitate the transfer of a paper-like material by applying electrical deformation properties to a roller used in the stamping apparatus.

However, despite the above-described prior arts, it is impossible to record information other than the simple pattern on the paper-like material due to the nature of the rotating roller. That is, a concave-convex portion formed on the press roller cannot be changed in real time, and thus it is only possible to stamp a pattern that gives a simple verification on the paper-like material.

SUMMARY OF THE INVENTION

The present invention has been made in an effort to solve the above-described problems associated with prior art, and an object of the present invention is to provide a press-type automatic stamping apparatus.

Another object of the present invention is to provide a press-type automatic stamping method.

According to an aspect of the present invention to achieve the above object of the present invention, there is provided an automatic stamping apparatus comprising: a conveyor for conveying a stamping object at a predetermined speed; a stamper for stamping a pattern and two-dimensional bar code information on the stamping object conveyed by the conveyor; a reader for reading the pattern and the two-dimensional bar code information stamped by the stamper on the stamping object conveyed by the conveyor; and an information processor for determining a pattern and two-dimensional bar code information to be stamped on the stamping object, controlling the stamper based on the determined pattern and two-dimensional bar code information, receiving the stamped pattern and two-dimensional bar code information of the stamping object read by the reader, comparing the received stamped pattern and two-dimensional bar code information with a pattern and two-dimensional bar code information to be stamped on the stamping object, thus verifying the accuracy of the stamping.

The stamping object may comprise a paper-like material including a postal matter, an invoice, a bill, and a receipt.

The conveyor may comprise at least one selected from the group consisting of a conveyor belt, a robot arm, and a feeding roller.

The stamper may comprise at least one press roller for stamping a pattern on the stamping object and at least one pin press for stamping a two-dimensional bar code on the stamping object.

The pin press may comprise a plurality of pins two-dimensionally arranged, and each of the plurality of pins may determine whether to press the stamping object.

A gap between the press roller and the pin press can be controlled in the axial direction that the conveyor conveys the stamping object.

According to another aspect of the present invention to achieve the above object of the present invention, there is provided an automatic stamping method implemented in an automatic stamping apparatus comprising at least one press roller for stamping a pattern on a stamping object and at least one pin press for forming a two-dimensional bar code on the stamping object, the method comprising: identifying the stamping object and determining a pattern and two-dimensional bar code information to be stamped on the stamping object; selecting a mold of the press roller based on the determined pattern information; selecting the pin press based on the determined two-dimensional bar code information; forming the determined pattern and a two-dimensional bar code on the stamping object using the press roller and the pin press; reading the pattern and the two-dimensional bar code information formed on the stamping object; and comparing the pattern and two-dimensional bar code information formed on the stamping object with a pattern and two-dimensional bar code information to be stamped on the stamping object, thus verifying the accuracy of the stamping.

The stamping object may comprise a paper-like material including a postal matter, an invoice, a bill, and a receipt.

The pin press may comprise a plurality of pins two-dimensionally arranged, and each of the plurality of pins may determine whether to press the stamping object.

The two-dimensional bar code information may comprise at least one selected from the group consisting of a processing agency name, a processing date, and a charge.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
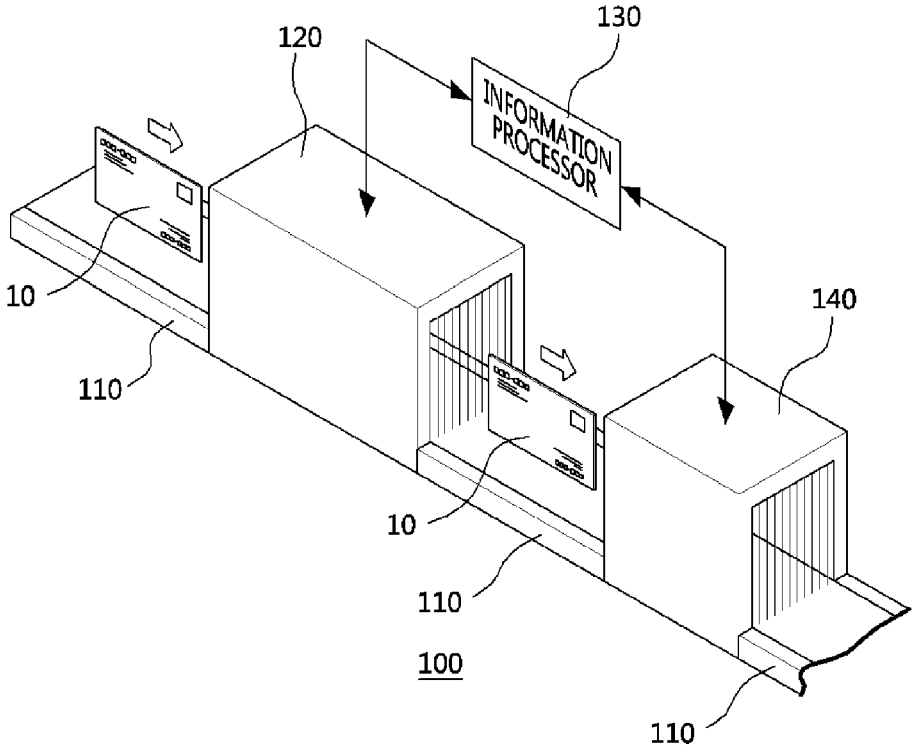
FIG. 1 is a conceptual diagram illustrating the configuration of an automatic stamping apparatus based on a press roller and a pin press in accordance with an exemplary embodiment of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, A, B etc. may be used herein to describe various elements, these elements should not be limited by these terms. These terms are only used to distinguish one element from another. For example, a first element could be termed a second element, and similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms, including technical and scientific terms, used herein have the same meaning as commonly understood by one of ordinary skill in the art to which this invention pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be described in detail with reference to the accompanying drawings.

Automatic Stamping Apparatus According to the Present Invention

FIG. 1 is a conceptual diagram illustrating the configuration of an automatic stamping apparatus based on a press roller and a pin press in accordance with an exemplary embodiment of the present invention.

Referring to FIG. 1, an automatic stamping apparatus 100 in accordance with an exemplary embodiment of the present invention may comprise a conveyor 110, a stamper 120, an information processor 130, and a reader 140.

While FIG. 1 illustrates a case in which a letter or bill is put into the automatic stamping apparatus 100 of the present invention, a stamping object 10 processed by the automatic stamping apparatus 100 may include any paper-like material, which requires a plurality of stampings in a short time, such as a letter, bill, invoice, etc.

First, the conveyor 110 supplies a stamping object 10 such as a standard letter, bill, etc. at a predetermined speed to the stamper 120 and conveys the stamping object 10 stamped by the stamper 120 to the reader 140. Moreover, the stamping object 10 processed by the reader 140 may be conveyed by the conveyor 110.

That is, as shown in FIG. 1, the conveyor 110 supplies the stamping object 10 to the stamper 120 at a constant speed using a conveyor belt. Here, the conveyor 110 may be configured to convey the stamping object 10 using a single conveyor belt over the entire process through the stamper 120 and the reader 140. Otherwise, the conveyor 110 may be configured to process the stamping object 10 using a plurality of conveyor belts such that the stamping object 10 can be processed step by step. Moreover, a variety of conveying means, such as a robot arm, roller, etc, which can move the stamping object 10 to a desired position can be applied.

The stamping object 10 moved to the stamper 120 by the conveyor 110 has a pattern formed by a press roller and a pin press that constitute the stamper 120 and then has a two-dimensional bar code formed in a press manner. A detailed description of the stamper 120 will be described with reference to FIG. 2 later.

Meanwhile, the information processor 130 changes a press mold attached to the press roller by controlling the stamper 120 or changes the pattern formed by the press roller and the two-dimensional bar code information recorded by the pin press by modifying the pin press.

The stamping object passing through the stamper 120 is conveyed to the reader 140 by the conveyor 110.

The reader 140 reads the pattern and the two-dimensional bar code information formed by the stamper 120. Here, the information read by the reader 140 is input again to the information processor 130 such that the information processor 130 compares the information read by the reader 140 with information which is intended to be stamped on the corresponding stamping object 10 to determine whether they coincide with each other, thereby verifying whether the stamping is normally made.

Figure 2:
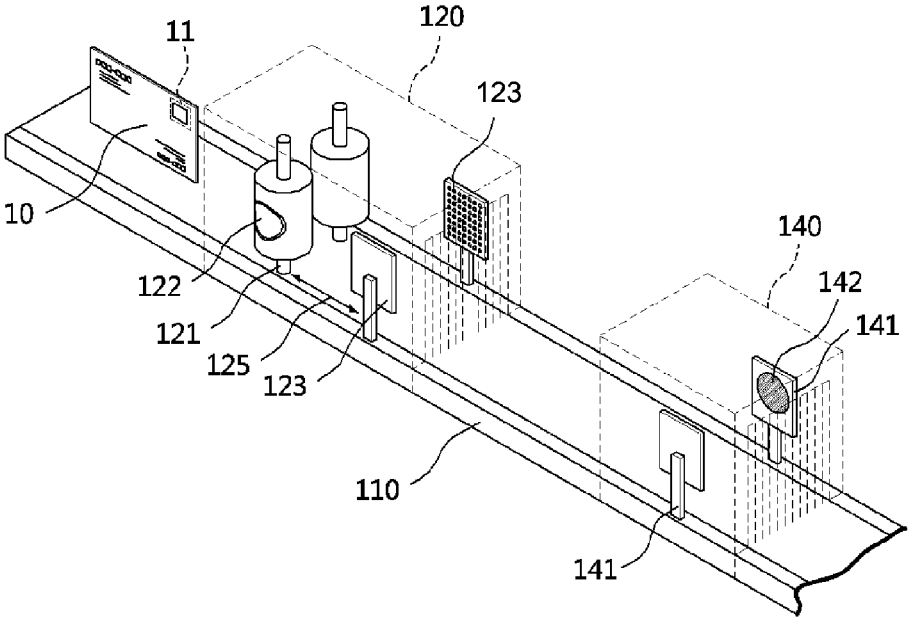
FIG. 2 is a conceptual diagram illustrating the configuration of a stamper and a reader that constitute an automatic stamping apparatus in accordance with an exemplary embodiment of the present invention.

FIG. 2 is a conceptual diagram illustrating the configuration of the stamper and the reader that constitute the automatic stamping apparatus in accordance with an exemplary embodiment of the present invention.

Referring to FIG. 2, the stamper 120 according to the present invention may comprise a press roller 121 and a pin press 123. The press roller 121 forms a pattern using a mold 122 attached to or formed on the press roller 121 at a specific position of the stamping object 10 put into the automatic stamping apparatus, and the pin press 123 receives two-dimensional bar code information such as agency name, date, etc. from the information processor 130 and stamps a two-dimensional bar code at a specific position of the stamping object 10. Meanwhile, the pin press 123 means a press having a structure, in which a plurality of pins are two-dimensionally arranged and can be selected based on the two-dimensional bar code information in the form of a projection or a recess.

Here, the position of the base pattern and peripheral pattern formed by the press roller and the position of the two-dimensional bar code formed by the pin press may overlap each other or may be placed at different positions. Moreover, the mold 122 attached to the press roller 121 and forming a pattern on the stamping object may be automatically selected and replaced by the information processor 130 or a fixed mold may be used to form the same pattern. Here, the press roller 121 may be fixed and operated in a manner that a mold attached to the press roller 121 is replaced. Otherwise, the press roller itself, to which a fixed mold is attached, may be replaced as occasion demands. Moreover, it is preferred that the surface rotation speed of the press roller 121 is maintained the same as the speed at which the conveyor 110 conveys the stamping object 10.

Moreover, it is also preferred that a gap 125 between the press roller 121 and the pin press 123 is controlled by the information processor 130. This is because it is possible to control the position, at which the pattern and the two-dimensional bar code information are recorded, by controlling the speed at which the conveyor 110 conveys the stamping object 10, the rotation speed of the press roller 121, and the gap 125 between the press roller 121 and the pin press 123. To this end, the press roller 121 and the pin press 123 may be configured such that the gap 125 between the press roller 121 and the pin press 123 can be controlled by a servo motor along a predetermined rail.

Referring to FIG. 2, the reader 140 according to the present invention reads the base, central, and peripheral patterns formed on the stamping object 10 and compares the read patterns with the information received from the information processor 130.

The reader 140 may be configured to read the stamped pattern and/or two-dimensional bar code information using a contact-type optical sensor 142 capable of reading the stamped paternal and/or two-dimensional bar code information or using image recognition with a camera.

Automatic Stamping Method According to the Present Invention

Figure 3:
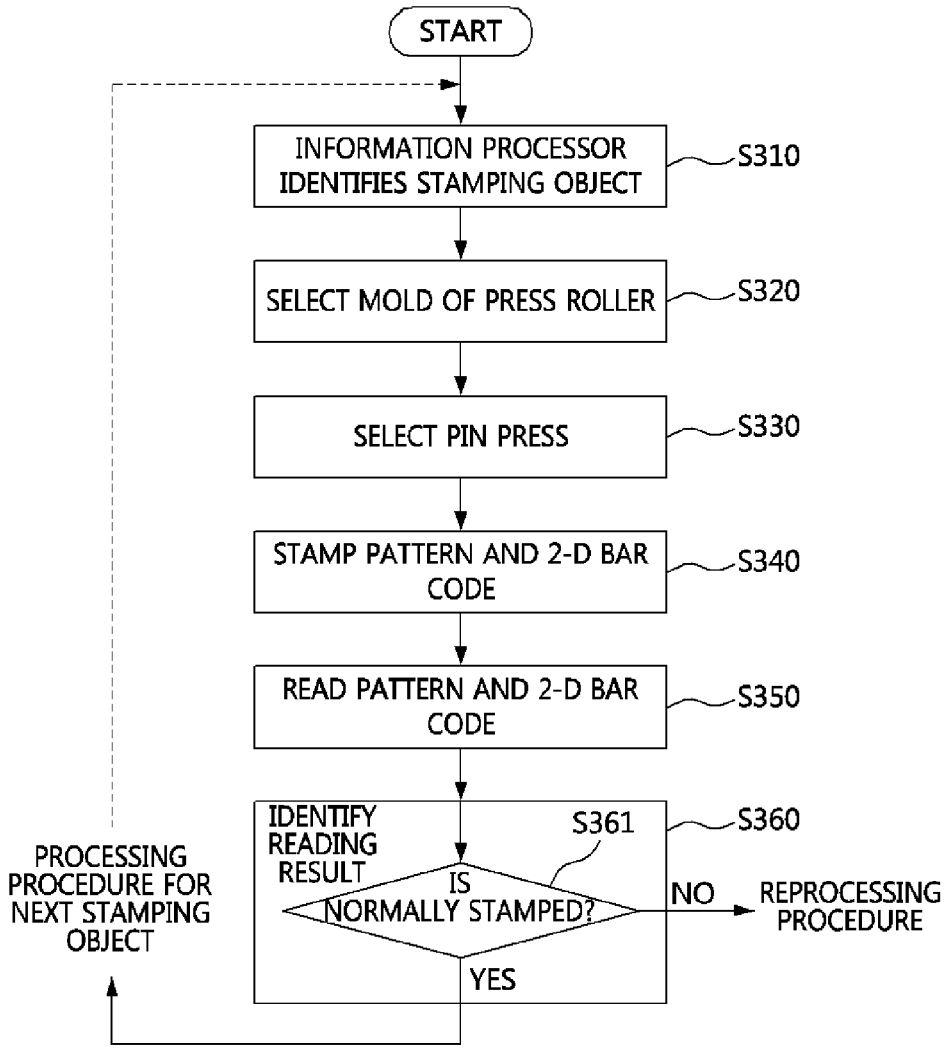
FIG. 3 is a flowchart illustrating an automatic stamping method based on a press roller and a pin press in accordance with another exemplary embodiment of the present invention.

FIG. 3 is a flowchart illustrating an automatic stamping method based on a press roller and a pin press in accordance with another exemplary embodiment of the present invention.

Referring to FIG. 3, an automatic stamping method in accordance with an exemplary embodiment of the present invention may comprise a step (S310) in which an information processor identifies a stamping object, a step (S320) in which the information processor selects a mold of a press roller based on the identification result, a step (S330) of selecting a pin press to stamp a two-dimensional bar code containing information such as an agency name, date, charge, etc., a step (S340) of stamping a pattern and a two-dimensional bar code using the press roller and the pin press, a step (S350) of reading the stamped pattern and two-dimensional bar code information, and a step (S360) of identifying the reading result.

First, in the step (S310) in which the information processor identifies a stamping object, the information processor recognizes the stamping object conveyed to a stamper by a conveyor. That is, when the stamping objects are conveyed in a predetermined order, the stamping objects can be identified in the order the stamping objects are conveyed. Otherwise, when the information processor is connected to an optical recognition module, information of the stamping object can be read by the optical recognition module to identify the stamping object. For example, if the stamping object is a postal matter or courier invoice, a bar code attached during reception may be an identification object of the optical recognition module.

Next, in the step (S320) in which the information processor selects a mold of a press roller based on the identification result, the type of a pattern to be formed is determined according to the type of the stamping object, and a mold attached to the press roller is replaced or a press roller to which a fixed mold is attached is replaced. If the stamping objects of the same type are continuously conveyed to the stamper 120, there is no need to perform the replacement of the mold.

In the step (S330) of selecting a pin press to stamp a two-dimensional bar code containing information such as an agency name, date, charge, etc., a pin of the pin press for stamping the two-dimensional bar code is selected based on the information to be recorded on the stamping object. As mentioned above, the pin press is a press having a structure, in which a plurality of pins are two-dimensionally arranged and can be selected based on the two-dimensional bar code information in the form of a projection or a recess, and thus the two-dimensional bar code information stamped by the selected pin can be modified.

Next, in the step (S340) of stamping a pattern and a two-dimensional bar code using the press roller and the pin press, a pattern and a two-dimensional bar code are stamped using the press roller and the pin press selected by the information processor. The pattern and the two-dimensional bar code are formed on the stamping object conveyed by the conveyor. Here, the positions of the pattern and the two-dimensional bar code can be controlled by controlling the speed at which the conveyor conveys the stamping object, the rotation speed of the press roller, and the gap between the press roller and the pin press.

In the step (S350) of reading the stamped pattern and two-dimensional bar code information, the pattern and the two-dimensional bar code information stamped by the press roller and the pin press are read by the reader and transmitted to the information processor.

Lastly, in the step (S360) of identifying the reading result, the result read by the reader is transmitted to the information processor, and the information processor compares the pattern to be recorded on the corresponding stamping object with the reading result and verifies whether the stamping is normally made. For example, the step (S360) of identifying the reading result may comprise a step (S361) of dividing a reprocessing procedure and a processing procedure for the next stamping object based on the verification result.

As described above, according to the automatic stamping method and apparatus of the present invention, it is possible to reduce the maintenance cost incurred when a postmark and a receipt mark are stamped on a letter as a general postal matter and a bill issued by a public institution using ink and to solve the problem that the postmark and the receipt mark are difficult to identify due to water. Moreover, it is possible to maintain the identification of the postmark and the receipt mark even when the postmark and the receipt mark get wet with water.

While the invention has been particularly shown and described with reference to exemplary embodiments thereof, it will be understood by those of ordinary skill in the art that various changes in form and details may be made therein without departing from the spirit and scope of the invention as defined by the following claims.

What is claimed is:

1. An automatic stamping apparatus comprising:

a conveyor for conveying a stamping object at a predetermined speed;

a stamper for stamping a pattern and two-dimensional bar code information on the stamping object conveyed by the conveyor;

a reader for reading the pattern and the two-dimensional bar code information stamped by the stamper on the stamping object conveyed by the conveyor; and an information processor for determining a pattern and two-dimensional bar code information to be stamped on the stamping object, controlling the stamper based on the determined pattern and two-dimensional bar code information, receiving the stamped pattern and two-dimensional bar code information of the stamping object read by the reader, comparing the received stamped pattern and two-dimensional bar code information with a pattern and two-dimensional bar code information to be stamped on the stamping object, thus verifying the accuracy of the stamping, wherein the stamper comprises at least one press roller for stamping the pattern on the stamping object and at least one pin press for stamping the two-dimensional bar code information on the stamping object, and the press roller and the pin press are configured such that a gap between the press roller and the pin press in an axial direction that the conveyor conveys the stamping object is adjustable, and wherein the automatic stamping apparatus further comprises a servo motor and a predetermined rail, wherein the information processor controls the servo motor to adjust the gap between the press roller and the pin press along the predetermined rail.

2. The automatic stamping apparatus of claim 1, wherein the stamping object comprises a paper-like material including a postal matter, an invoice, a bill, and a receipt.

3. The automatic stamping apparatus of claim 1, wherein the conveyor comprises at least one selected from the group consisting of a conveyor belt, a robot arm, and a feeding roller.

4. The automatic stamping apparatus of claim 1, wherein the pin press comprises a plurality of pins two-dimensionally arranged, and each of the plurality of pins determines whether to press the stamping object.

5. The automatic stamping apparatus of claim 1, wherein the conveyor is a conveyor belt.

6. The automatic stamping apparatus of claim 1, wherein the conveyor is a robot arm.

7. The automatic stamping apparatus of claim 1, wherein a mold is attached to or formed on the press roller and the mold is pressed onto the stamping object to form the pattern.

8. An automatic stamping method implemented in an automatic stamping apparatus comprising at least one press roller for stamping a pattern on a stamping object and at least one pin press for forming a two-dimensional bar code information on the stamping object, the method comprising:

conveying the stamping object at a predetermined speed by a conveyor;

identifying the stamping object and determining a pattern and a two-dimensional bar code information to be stamped on the stamping object;

selecting a mold of the press roller based on the determined pattern information;

selecting the pin press based on the determined two-dimensional bar code information;

adjusting a gap between the press roller and the pin press in an axial direction that the conveyor conveys the stamping object;

forming the determined pattern and the determined two-dimensional bar code information on the stamping object using the press roller and the pin press;

reading the pattern and the two-dimensional bar code information formed on the stamping object; and comparing the pattern and the two-dimensional bar code information formed on the stamping object with said pattern and said two-dimensional bar code information determined to be stamped on the stamping object, thus verifying the accuracy of the stamping, wherein the automatic stamping apparatus further comprises an information processor, a servo motor and a predetermined rail, and, in the step of adjusting the gap, the information processor controls the servo motor to adjust the gap between the press roller and the pin press along the predetermined rail.

9. The automatic stamping method of claim 8, wherein the stamping object comprises a paper-like material including a postal matter, an invoice, a bill, and a receipt.

10. The automatic stamping method of claim 8, wherein the pin press comprises a plurality of pins two-dimensionally arranged, and each of the plurality of pins determines whether to press the stamping object.

11. The automatic stamping method of claim 8, wherein the two-dimensional bar code information comprises at least one selected from the group consisting of a processing agency name, a processing date, and a charge.

12. The automatic stamping method of claim 8, wherein the conveyor is a conveyor belt.

13. The automatic stamping method of claim 8, wherein the conveyor is a robot arm.

* * * * *